United States Patent [19]

Taupin

[11] Patent Number: 4,777,778

[45] Date of Patent: Oct. 18, 1988

[54] FASTENER FOR FIXING WALL-COVERING MATERIAL TO A BATTEN

[75] Inventor: Marcel Taupin, Blanc-Mesnil, France

[73] Assignee: Etudes G.P. Realisations, Pont-Sur-Yonne, France

[21] Appl. No.: 6,887

[22] Filed: Jan. 27, 1987

[30] Foreign Application Priority Data

Jan. 27, 1986 [FR] France ..... 86 01070

[51] Int. Cl.[4] ..... E04B 1/40

[52] U.S. Cl. ..... 52/714; 403/393; 403/405.1; 411/461; 411/478

[58] Field of Search ..... 411/461, 466, 457, 478, 411/477, 503; 52/509, 714, 715, 483; 403/393, 405.1

[56] References Cited

U.S. PATENT DOCUMENTS

| | | | |
|---|---|---|---|
| 1,377,424 | 5/1921 | Milliken | 411/461 X |
| 1,399,183 | 12/1921 | Bicker | 411/461 X |
| 1,531,916 | 3/1925 | Flintjer | 411/461 X |
| 2,325,766 | 8/1943 | Gisondi | 411/461 X |
| 2,742,778 | 4/1956 | Olmstead | 411/461 X |
| 3,708,942 | 1/1973 | Leonard | 411/466 X |
| 4,141,191 | 2/1979 | Aarons | 52/715 |
| 4,255,914 | 3/1981 | Seipos | 52/509 X |
| 4,313,688 | 2/1982 | Daniels | 52/715 X |
| 4,525,902 | 7/1985 | Haytayan | 411/461 X |
| 4,527,308 | 7/1985 | Tritton et al. | 411/457 X |

FOREIGN PATENT DOCUMENTS

| | | | |
|---|---|---|---|
| 435292 | 10/1926 | Fed. Rep. of Germany | 411/461 |
| 3205706 | 12/1982 | Fed. Rep. of Germany . | |
| 12841 | 6/1903 | United Kingdom | 411/461 |
| 2115449 | 9/1983 | United Kingdom . | |

*Primary Examiner*—Lloyd A. Gall

*Attorney, Agent, or Firm*—Amster, Rothstein & Ebenstein

[57] ABSTRACT

In this fastener which comprises a base plate suitable for being fixed to a batten, at least one retaining tab which is integrally formed with the base plate and which is suitable for retaining a piece of covering material, and two fixing tabs which extend sideways from two respective opposite parallel edges of the base plate and which, when the base plate is placed on a batten, are suitable for being folded down against opposite sides of the batten, there is provided, in addition, at least one spike integrally formed with each fixing tab and extending perpendicularly thereto for gripping the batten after the fixing tab has been folded down there against.

18 Claims, 2 Drawing Sheets

FASTENER FOR FIXING WALL-COVERING MATERIAL TO A BATTEN

BACKGROUND OF THE INVENTION

1. Field of the Invention

The present invention relates to a fastener for fixing wall-covering material to a batten, the fastener being of the type comprising a base plate suitable for being fixed to the batten, and at least one retaining tab for retaining the covering material and integrally formed with the base plate.

2. Prior Art

Covering materials which include at least one first edge with a longitudinally extending groove and at least one second edge on the opposite side to the first with a longitudinally extending tongue suitable for engaging in the groove of an adjacent piece of covering material, e.g. panels, clap-board, and decorative or insulating slabs, are usually fixed to wooden battens which have previously been fixed to a wall, a ceiling, or other surface to be covered. Fasteners of the type specified above have already been proposed for fixing such covering materials to wooden battens. The retaining tab of each fastener is generally cut out from a base plate and folded so as to have a first branch extending in a plane perpendicular to the base plate and to two of the parallel edges thereof, and a second branch which is parallel to said base plate and which is situated to one side of said plane. Such a fastener is generally placed on the edge of the covering material where it crosses a batten, with the second branch of the retaining tab being engaged in the groove of the covering material, and with the base plate of the fastener being pressed against the batten and being fixed thereto by nails or by staples passing through one or more holes or openings provided in that portion of the base plate which extends in the opposite direction (relative to the plane of the first branch of the retaining tab) to the direction in which the second branch of the retaining tab extends. Fasteners of this type have the advantage of being invisible after the tongue of the next piece of covering material has been engaged in the groove of the piece of covering material which has just been fixed to the batten. However, there are several drawbacks related to the fastener being fixed to the batten by nails or staples. Firstly, nails or staples tend to split or even break wooden battens. This is practically inevitable when the nail or staple is fixed near to an end of the batten. Secondly, nailing or stapling perpendicularly to the front face of a batten provides relatively poor resistance to the nail being drawn back out from the batten. Thirdly, there is a danger of loosening of the batten's own fixing, and as a result battens may become detached from the wall, ceiling or other support surface, or at best the assembly constituted by the battens and the covering material is held in place only relatively loosely. Fourthly, in order to fix covering material in the angle between two walls, it is necessary to leave a gap between one of the two walls and the edge of the covering material in order to make it possible for a fastener to be put into position and fixed. This gap must be at least as wide as the hammer or the stapler used for driving the nails or the staples. If such a gap is not provided, then the covering material must be fixed either by being directly nailed to the batten or else by nailing in place a corner strip, for example a quarter-round strip. In either case, there is a risk of damaging the covering material and/or of splitting the wooden battens, since this nailing necessarily takes place at the end of a batten.

U.S. Pat. No. 2,325,766 describes fixing a fastener including a base plate on a wooden beam by means of side fixing tabs, however additional nailing through the base plate is also necessary and the fastener is not provided for installing paneling or the like, but for installing covering planks which do not have tongues or grooves on their edges and which have fixing teeth provided on the fastener forced into their thicknesses. In other words, this prior fastener is not provided with retaining tabs for engaging in the groove of a panel or the like, as is the fastener of the present invention.

SUMMARY OF THE INVENTION

The aim of the present invention is to provide a fastener which may be fixed to a wooden batten without risk of loosening the batten's own fixings and which, once fixed to the batten, is securely anchored against being drawn off the batten.

The present invention also aims to provide a fastener which can be fixed to a batten without using nails or staples and which therefore does not run the risk of splitting or breaking the batten.

The present invention also aims to provide a fastener which enables covering material to be fixed to a batten in an angle between two walls without it being necessary to provide a substantial space between the edge of the covering material and one of the two walls.

To this end, a fastener in accordance with the present invention which includes two fixing tabs extending sideways from two respective parallel edges of the base plate, and which are suitable for being folded back on either side of the batten when the fastener is placed thereon in order to encompass three sides thereof, includes the improvement whereby each fixing tab has at least one spike which is integrally formed with the fixing tab and which extends perpendicularly therefrom in order to engage in the batten when the fixing tab is folded back.

Advantageously, said spike also extends in a plane perpendicular to the edge of the base plate from which the associated fixing tab extends. Two spikes may be sufficient for each fixing tab and may extend from respective ones of the two opposite free edges of the tab, which free edges extend from the same edge of the base plate as the edge from which the fixing tab itself extends. Generally, the fixing tabs rae rectangular and the spikes are triangular, and advantageously the spikes are in the form of rightangle triangles.

BRIEF DESCRIPTION OF THE DRAWINGS

Embodiments of the invention are described by way of example with reference to the accompanying drawings, in which.

DESCRIPTION OF PREFERRED EMBODIMENTS

The fastener shown in FIGS. 1 to 4 is made from metal sheet which is cut and folded so as to include a base plate 1 which is generally rectangular in shape and a retaining tab 2 which is cut out in the base plate 1 and which comprises a first branch 2*a* folded at 90° relative to the base plate and a second branch 2*b* folded at 90° relative to the first branch 2*a*.

Figure 1:
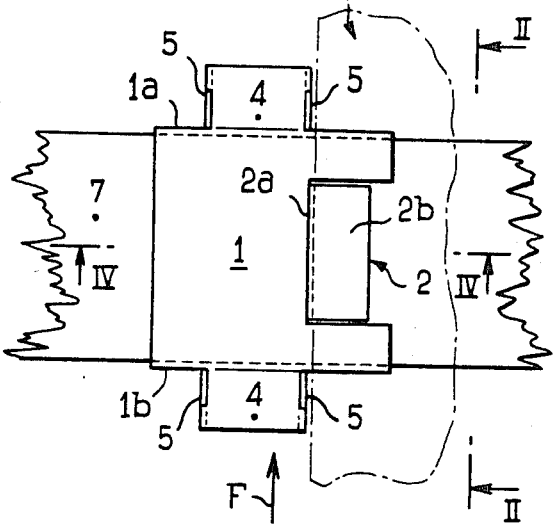
FIG. 1 is a face view of a first embodiment of a fastener in accordance with the present invention.

The fastener also includes two fixing tabs 4 which are integrally formed with the base plate 1 by being cut out together with the base plate from the same metal sheet. The two fixing tabs 4 extend sideways from respective opposite edges 1*a* and 1*b* of the base plate 1, as shown in FIG. 1, and they are both situated on the same side of the plane containing the first branch 2*a* of the retaining tab 2, with the second branch 2*b* of said retaining tab extending in the opposite direction from said plane, as can be seen most clearly in FIGS. 1, 3, and 4.

Figure 5:
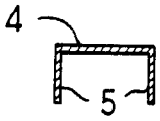
FIG. 5 is a section on line V—V of FIG. 2.
Figure 6:
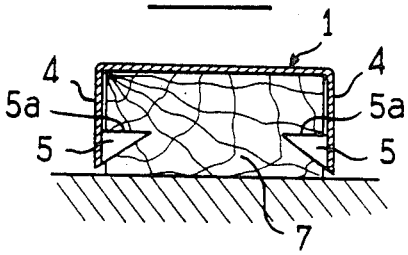
FIG. 6 is a section on line VI—VI of FIG. 3 after the fixing tabs of the fastener have been clinched.

Each of the two fixing tabs 4 has two spikes 5 which are integrally formed therewith and which extend perpendicularly therefrom, as shown in FIG. 5. The two spikes 5 of each fixing tab 4 extend from respective ones of the two free edges of the fixing tab that extend from the edges 1*a* and 1*b* of the base plate 1, and the spikes are preferably situated close to the furthest end of the fixing tab from the base plate, as can be seen more particularly in FIGS. 2 and 6. The two fixing tabs 4 are preferably rectangular as shown in the drawings, with the two spikes 5 on each of them being situated in planes extending perpendicularly to the edges 1*a* and 1*b* of the base plate, thereby having the advantage of being thrust into the edges of the batten 7 to which the fastener is fixed in a direction which is perpendicular to the grain of the wood, and thus without running the risk of splitting the batten longitudinally and so providing a connection which strongly resists the fastener being pulled off the batten. As shown in FIG. 6, the length of each of the fixing tabs 4 is substantially equal to the thickness of the batten 7. The spikes 5 are triangular in shape and preferably the edge 5*a* of each spike which is closest to the base plate 1 extends perpendicularly to the edge of the associated fixing tab 4, so that the spike is in the shape of a rightangle triangle.

Figure 2:
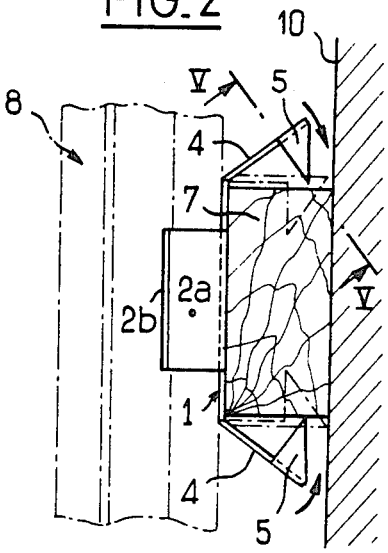
FIG. 2 is a section on line II—II of FIG. 1.
Figure 3:
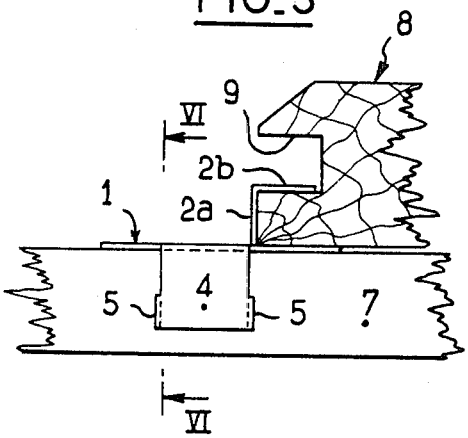
FIG. 3 is a view of the fastener looking along arrow F in FIG. 1.
Figure 4:
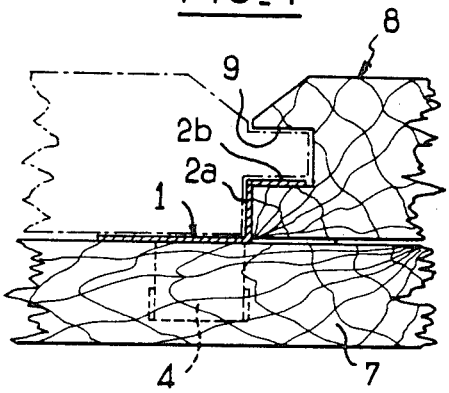
FIG. 4 is a section on line IV—IV of FIG. 1.

The two fixing tabs 4 may extend in the same plane as the base plate 1, but preferably they are pre-folded as shown in FIG. 2 so as to facilitate subsequent fixing of the fastener on a batten 7.

After the, or each, batten 7 has been fixed to a wall 10 (see FIG. 2) in conventional manner, for example by means of nails or screws (not shown), the covering material such as a panel 8 is fixed to each batten 7 in the following manner. A fastener, such as the fastener shown in FIGS. 1 to 4, is placed over the batten 7 and the base plate of the fastener is slid along the batten until the second branch 2*b* of the retaining tab 2 is fully engaged in the groove 9 of the panel 8. Then, the two fixing tabs 4 are manually clinched so as to begin driving the spikes into the edges of the batten 7. Then a clamping tool is used, e.g. a pair of slip-joint clamping pliers to drive the spikes 5 fully home into the edges of the batten 7 as shown in dot-dashed lines in FIG. 2 and in solid lines in FIG. 6. Because of their particular shape, as the spikes 5 are driven into the edges of the batten 7, the reaction force exerted by the wood of the batten on the edge 5a of the spikes has the effect of pressing the base plate 1 of the fastener firmly against the front face of the batten, thereby ensuring that the fastener is not loosely fixed on the batten. Further, given that the fastener is not fixed by means of nails or staples driven into the front face of the batten 7, but is fastened by the spikes 5 driven into the edges of the batten, the fastener is fixed to the batten in a way which provides much greater resistance to the fastener being pulled off the batten than has previously been the case, and in addition there is no risk of splitting the batten 7. In any event, even if the batten 7 does split, the resistance of the fastener to being pulled off the batten is in no way reduced since the split would extend perpendicularly to the spikes 5, i.e. in the longitudinal direction of the batten 7.

Figure 7:
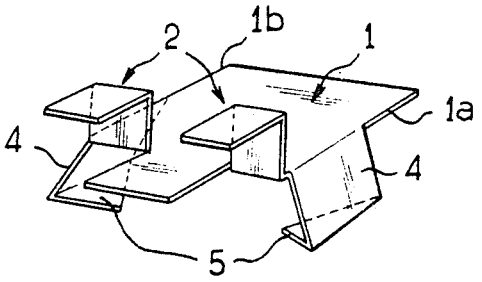
FIG. 7 is a perspective view of a second embodiment of a fastener in accordance with the invention.
Figure 8:
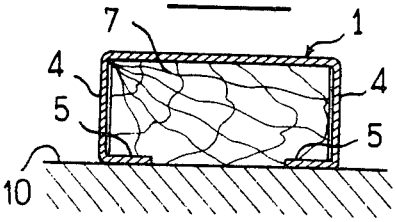
FIG. 8 is a section view similar to FIG. 6 but through the fastener shown in FIG. 7.
Figure 9:
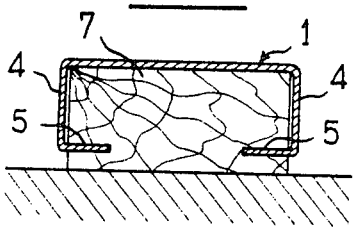
FIG. 9 is a section view similar to FIG. 8 showing a variant thereof.

FIG. 7 shows a second embodiment of a fastener in accordance with the present invention. In FIG. 7, items which are identical to those of the fastener shown in FIGS. 1 to 4 or which perform the same function are designated by the same reference numerals. The fastener shown in FIG. 7 differs from that shown in FIGS. 1 to 4 in that it includes two retaining tabs 2 and in that each fixing tab 4 includes only one spike 5 which extends from the end of the fixing tab 4 which is furthest from the base plate 1. The length of each fixing tab 4 is preferably equal to at least half the thickness of the batten 7 and to not more than said thickness. When the length of the fixing tabs 4 is substantially equal to the thickness of the batten 7, the two spikes 5 are engaged between the rear face of the batten 7 and the wall 10, as shown in FIG. 8, when the two fixing tabs 4 are clinched to encompass the batten 7. When the length of the fixing tabs 4 lies between the thickness of the batten 7 and one-half of said thickness, the spikes 5 are driven into the edges of the batten when the fixing tabs are clinched, as shown in FIG. 9. In either case, the resulting fixing provides good resistance to the fastener being pulled off the batten and with less risk of the batten 7 being split than if nails or staples had been driven into the front face thereof.

Figure 10:
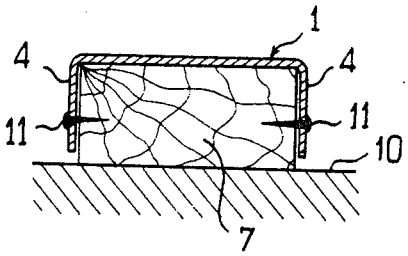
FIG. 10 is a section view showing another variant thereof.

FIG. 10 shows a variant embodiment in which both fixing tabs are fixed to the edges of the batten 7 by means of nails 11 (or by staples) which pass through holes provided in the fixing tabs 4. Here again, the fastener is fixed to the batten in a way which provides good resistance to the fastener being pulled off the batten and the risk of splitting the batten 7 is much less than it would be if the nails (or staples) were driven into the front face of the batten 7. In addition, even though nails 11 are used in this case for fixing the fastener to the batten, there is no risk of loosening the means which fix the batten to the supporting surface since the nails 11 can be driven into the edges of the batten without using a hammer, for example they can be driven in using the same pair of pliers as is used for folding the fixing tabs 4 against the edges of the batten.

Figure 11:
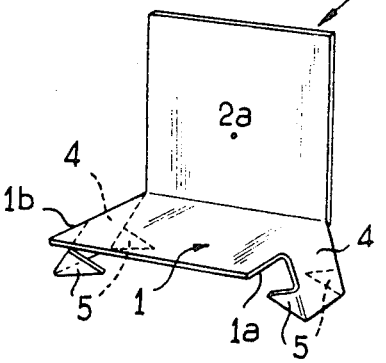
FIG. 11 is a perspective view of a third embodiment of a fastener in accordance with the invention.

FIG. 11 shows a third embodiment of a fastener in accordance with the present invention. In FIG. 11, parts of the fastener which are identical to corresponding parts in the above-described fasteners, or which perform the same function, are designated by the same reference numerals. The FIG. 11 fastener differs from the above-described fasteners in that each retaining tab 2 has only one branch 2*a* which is situated in a plane perpendicular to the base plate 1 and to its edges 1*a* and 1*b*. In addition, in the FIG. 11 fastener, the base plate 1 and the two fixing tabs 4 are entirely situated on one side of the plane containing the sole branch of the retaining tab 2, with the retaining tab 2 being sufficiently long for its terminal portion furthest from the base plate 1 to be capable of being folded over the covering material, as shown to the left of FIG. 12.

Figure 12:
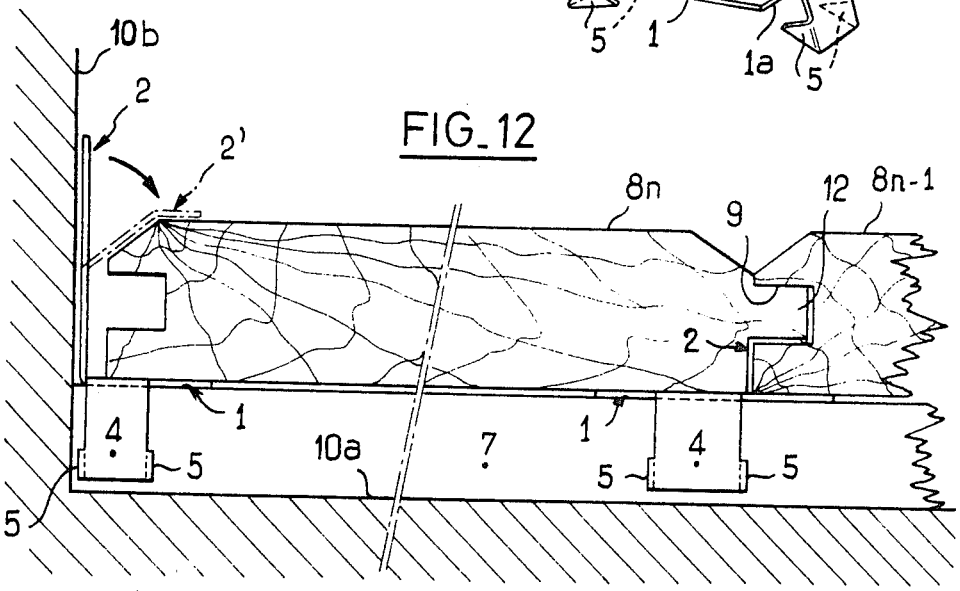
FIG. 12 is a view similar to FIG. 3 showing how the FIG. 11 fastener may be used for fixing covering material in the angle between two walls.

The FIG. 11 fastener is particularly suitable for fixing a last or a first piece of covering material, for example a last plate 8*n* in the angle between two walls 10*a* and 10*b* (see FIG. 12). In this case, after the penultimate plate 8*n*-1 has been fixed to the batten 7, for example by means of a fastener of the kind shown in FIGS. 1 to 4 (see the right-hand side of FIG. 12), the FIG. 11 fastener is initially placed against the wall 10b and is fixed to the batten 7 by clinching its two fixing tabs 4. Thereafter, the tongue 12 of the last panel 8*n* is engaged in the groove 9 of the penultimate panel 8*n*-1, by pivoting the last panel 8*n* about a virtual axis running parallel to the groove 9 and situated substantially in the opening thereto. Then, once the tongue 12 has been fully engaged in the groove 9 and the last panel 8n has been pressed against the batten 7, the terminal portion of the retaining tab 2 is folded down and pressed against the front face of the last panel 8*n* as shown in dot-dashed lines 2' to the left of FIG. 12, thereby retaining the last panel. As can be seen in FIG. 12, only a very small gap remains between the left-hand edge of the last panel 8*n* and the wall 10*b* ("left-hand" being with respect to FIG. 12). Such a small gap is easily hidden by other panels fixed to the wall 10*b* or by a suitable finishing strip.

The above disclosed embodiments of the present invention are indeed mere examples which are not at all limitative and many modifications may be easily brought to them by the one skilled in the art without departing from the spirit and scope of the present invention. Thus the number and shape of the retaining tabs 2 may be different from the ones shown in the drawings. For instance, the fastener of FIGS. 1 to 4 may be provided with two retaining tabs like the fastener of FIG. 7. Also the fastener of FIG. 11 may be provided with two retaining tabs like the fastener of FIG. 7, or with just one retaining tab having a width less than that of the base plate 1 like the fastener of FIG. 1. Moreover, the branch 2*b* of the retaining tab or tabs 2 may be provided on its front edge and in a known manner with at least one pointed tooth adapted to drive into the bottom of the groove 9 of the pieces 8 of covering material. In addition, instead of projecting from the edge or edges of the fixing tabs 4, the spike or spikes 5 may be cut out of said fixing tabs and bent at right angles with respect to the same.

I claim:

1. In combination, a wooden batten and a fastener for fixing wall-covering material to the batten, the fastener comprising a base plate fixed to the batten, at least one retaining tab integrally formed with the base plate for retaining the covering material, and two fixing tabs extending sideways from respective ones of two parallel edges of the base plate and folded back against either side of the batten, wherein each fixing tab includes two spikes which are triangular in shape, integrally formed with the fixing tab, and extend perpendicularly therefrom and in a plane perpendicular to the plane of the base plate and perpendicular to the grain of the wood of the batten, one of the two free edges of each spike which is closest to the base plate extending perpendicularly to the edge of the fixing tab from which the spike extends.

2. The combination of claim 1 further comprising a wall covering material having on one side a first longitudinal edge with a longitudinally extending groove therein and on the opposite side a second longitudinal edge with a longitudinally extending tongue suitable for engaging in the groove of an adjacent covering material, the retaining tab including a portion suitable for being engaged in the groove.

3. A fastener for fixing wall-covering material to a wooden batten, the fastener comprising a base plate suitable for being fixed to the batten, at least one retaining tab integrally formed with the base plate for retaining the covering matrial, and two fixing tabs extending sideways from respective ones of two parallel edges of the base plate and suitable, when said base plate is placed on the batten, for being folded back against either side of the batten, wherein each fixing tab includes at least one spike, two at most, which is integrally formed with the fixing tab and which extends perpendicular from an edge of said fixing tab and in a plane perpendicular to the plane of the base plate and perpendicular to the grain of the wood of the batten in order to grip the batten after said fixing tab has been folded back thereagainst, and wherein each spike is triangular in shape with the one of its two free edges closest to the base plate being parallel to the base plate after said fixing tab has been folded back against said batten.

4. A fastener according to claim 3, wherein each spike extends from the end of the corresponding fixing tab which is furthest from the base plate.

5. A fastener according to claim 4, wherein the length of each fixing tab is not less than one-half the thickness of the batten and not more than said thickness.

6. A fastener according to claim 3, wherein the retaining tab includes a first branch which is situated in a plane perpendicular to the base plate and to said two parallel edges from which the fixing tabs extend, and a second branch which extends parallel to said base plate and which is situated on one side of said plane, said second branch being suitable for being engaged in a groove provided in the edge of a piece of covering material, and wherein both fixing tabs are located on the other side of said plane.

7. A fastener according to claim 3, wherein the retaining tab comprises a branch which is situated in a plane perpendicular to the base plate and to said two parallel edges thereof from which the fixing tabs extend, with the base plate and the fixing tabs being situated entirely to one side of said plane, and with the retaining tab being of sufficient length to enable its terminal portion to be folded down against the covering material to be fixed to the batten.

8. A fastener for fixing wall-covering material to a wooden batten, the fastener comprising a base plate suitable for being fixed to the batten, at least one retaining tab integrally formed with the base plate for retaining the covering material, and two fixing tabs extending sideways from respective ones of two parallel edges of the base plate and suitable, when said base plate is placed on the batten, for being folded back against either side of the batten, wherein each fixing tab includes two spikes which are integrally formed with the fixing tab and which extend perpendicularly therefrom and in a plane perpendicular to the plane of the base plate and perpendicular to the grain of the wood of the batten in order to grip the batten after said fixing tab has been folded back thereagainst, wherein each spike is triangular in shape with the one of its two free edges closest to the base plate being parallel to the base plate after said fixing tab has been folded back against said batten, and wherein said two spikes project from respective ones of two opposite free edges of the fixing tab, said opposite edges both extending from that edge of the base plate from which the fixing tab extends.

9. A fastener according to claim 1 having a plurality of said retaining tabs spaced from and aligned with each other.

10. A fastener according to claim 1, wherein the two spikes are situated close to the end of the fixing tab which is furthest from the base plate.

11. A fastener according to claim 10, wherein the length of each fixing tab is substantially equal to the thickness of the batten.

12. A fastener according to claim 1, wherein the two fixing tabs are rectangular.

13. A fastener according to claim 12, wherein both spikes are situated close to the end of the fixing tab which is furthest from the base plate.

14. A fastener according to claim 13, wherein the length of each fixing tab is substantially equal to the thickness of the batten.

15. A fastener according to claim 13, wherein the retaining tab includes a first branch which is situated in a plane perpendicular to the base plate and to said two parallel edges from which the fixing tabs extend, and a second branch which extends parallel to said base plate and which is situated on one side of said plane, said second branch being suitable for being engaged in a groove provided in the edge of a piece of covering material, and wherein both fixing tabs are located on the other side of said plane.

16. A fastener according to claim 13, wherein the retaining tab comprises a branch which is situated in a plane perpendicular to the base plate and to said two parallel edges thereof from which the fixing tabs extend, with the base plate and the fixing tabs being situated entirely to one side of said plane, and with the retaining tab being of sufficient length to enable its terminal portion to be folded down against the covering material to be fixed to the batten.

17. A fastener according to claim 14, wherein the retaining tab includes a first branch which is situated in a plane perpendicular to the base plate and to said two parallel edges from which the fixing tabs extend, and a second branch which extends parallel to said base plate and which is situated on one side of said plane, said second branch being suitable for being engaged in a groove provided in the edge of a piece of covering material, and wherein both fixing tabs are located on the other side of said plane.

18. A fastener according to claim 14, wherein the retaining tab comprises a branch which is situated in a plane perpendicular to the base plate and to said two parallel edges thereof from which the fixing tabs extend, with the base plate and the fixing tabs being situated entirely to one side of said plane, and with the retaining tab being of sufficient length to enable its terminal portion to be folded down against the covering material to be fixed to the batten.

* * * * *